United States Patent [19]

Presby

[11] 4,219,898

[45] Sep. 2, 1980

[54] FLOATING BRUSH FLOOR CLEANER

[76] Inventor: Harry A. Presby, 106 S. Curry St., Carson City, Nev. 89701

[21] Appl. No.: 11,805

[22] Filed: Feb. 14, 1979

[51] Int. Cl.[2] ..... A47L 11/164

[52] U.S. Cl. ..... 15/49 R; 15/180; 51/177

[58] Field of Search ..... 15/49 R, 50 R, 98, 180; 51/177; 125/3

[56] References Cited

U.S. PATENT DOCUMENTS

| | | | |
|---|---|---|---|
| 1,139,407 | 5/1915 | Finnell | 15/49 R |
| 1,645,317 | 10/1927 | Carroll | 15/49 R X |
| 1,932,319 | 10/1933 | Myers | 51/177 |
| 2,242,577 | 5/1941 | Finnell | 15/180 |
| 2,539,054 | 1/1951 | Breuer et al. | 15/50 R X |
| 3,115,654 | 12/1963 | Zimmerman | 15/49 R |
| 3,678,529 | 7/1972 | Woods et al. | 15/180 |

*Primary Examiner*—Edward L. Roberts

*Attorney, Agent, or Firm*—Blair, Brown & Kreten

[57] ABSTRACT

Disclosed herein is a floating brush floor cleaner characterized in that a plurality of brushes are pivotally connected to the bottom face of a floor polishing machine. The manner in which these plural brushes are connected thereto provide independent action for each of the brushes to conform to the contour of the surface to be cleaned and includes a brush portion, a steel band nested around the brush, angle irons fastened to the top face of the brush, and a connection link between the bottom of the floor cleaning machine shroud or steel plate and the brush so that each brush is independently connected and capable of tracking an uneven contour of the floor.

6 Claims, 7 Drawing Figures

FIG 4
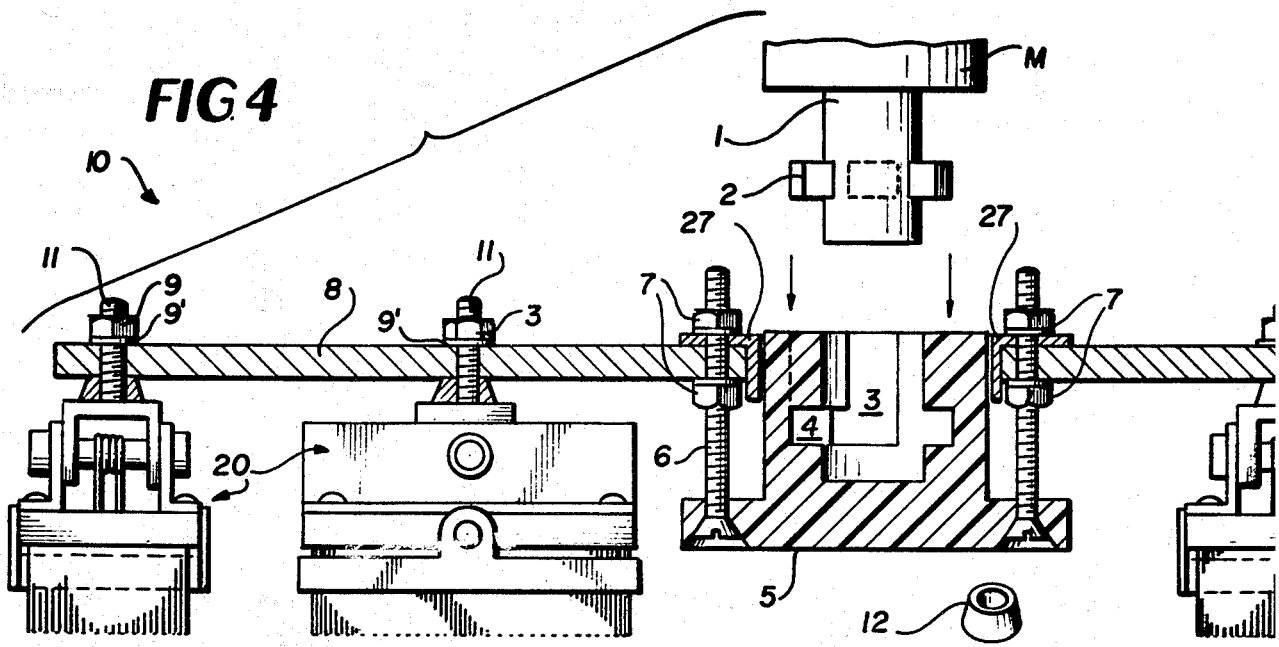
FIG. 5
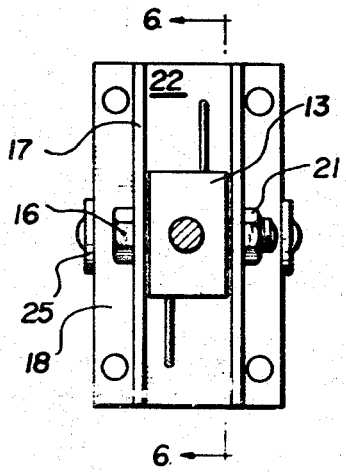
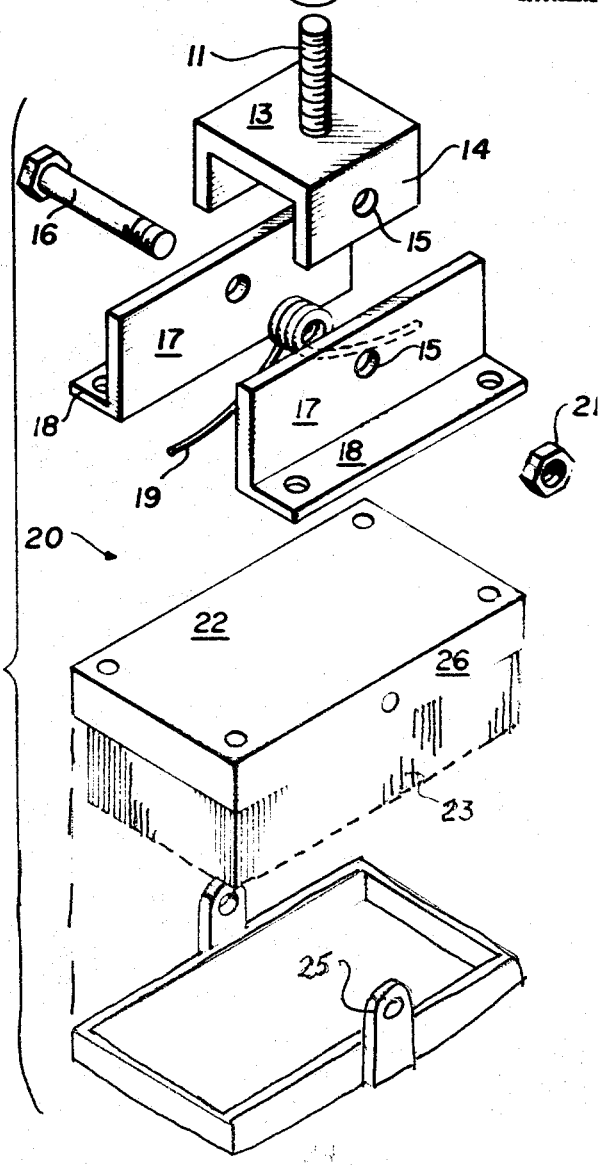
FIG 6
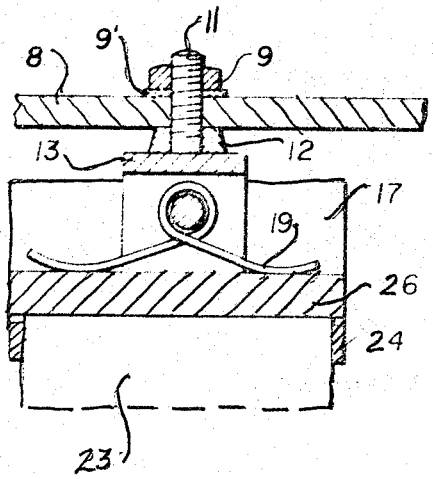
FIG 7

FLOATING BRUSH FLOOR CLEANER

BACKGROUND OF THE INVENTION

Conventional brushes used for cleaning or buffing floors can generally be regarded as being provided with one integal circular disc or buffing pad connected to the bottom face of the polishing of buffing machine and it should be noted that since there is but one single unitary brush, buffing pad, or similar type of cleaning surface on the bottom face thereof that a floor that is wraped or has an undulating surface will not benefit from a thorough cleaning or buffing action when using a conventional type of machine. Indeed, to a professional job, it has been found to be necessary in the past either to use a smaller type of circular brush that will ride within these ridges or low spots, or alternatively to treat those portions of the floor manually. This results of course in a considerable labor expenditure.

SUMMARY OF THE INVENTION

It is therefor an object of this invention to provide a machine for use on floors for cleaning or waxing etc. in which a plurality of brushes or pads coact against the floor whereby each brush is pivotable relative to the yoke that holds it on the machine so that each brush may conform to the surface irregularities of the floor to be worked on.

Another object contemplates providing a floor polishing or buffing machine in which the length of bristles which extend downwardly and coact against the floor can be adjusted relative to be centrally disposed member.

A further object contemplates adjusting the support member in such a manner that the weight of the machine is distributed partially on the support member and on the bristles so that the bristles do not become unduly deformed.

These and other objects will be made manifest when considering the following detailed specification and drawings.

BRIEF DESCRIPTION OF THE DRAWINGS

FIG. 4 is a sectional view taken along lines 4—4 of FIG. 3;

FIG. 5 is a detailed top plan view of a single brush looking down thereon;

FIG. 6 is a sectional view taken along lines 6—6 of FIG. 5; and

FIG. 7 is an exploded parts view of an individual brush component.

DESCRIPTION OF THE PREFERRED EMBODIMENT

Figure 1:
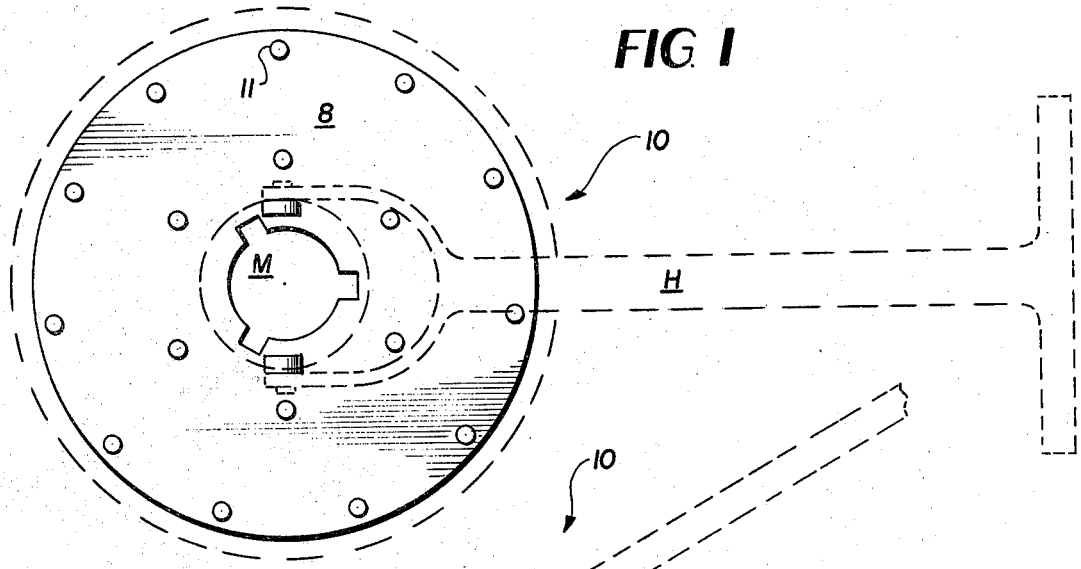
FIG. 1 is a top plan view of the machine according to the present invention.
Figure 2:
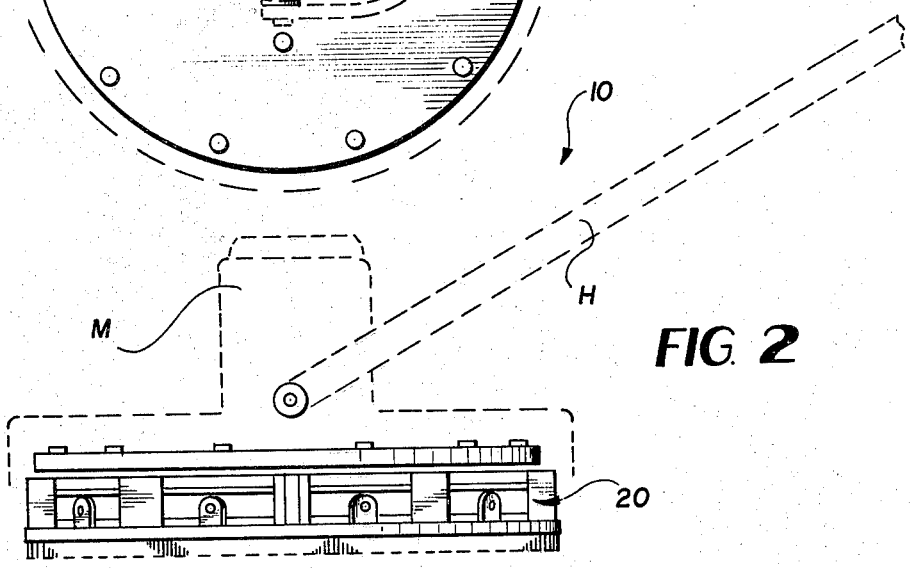
FIG. 2 is a side view thereof showing the brushes in an exposed condition.
Figure 3:
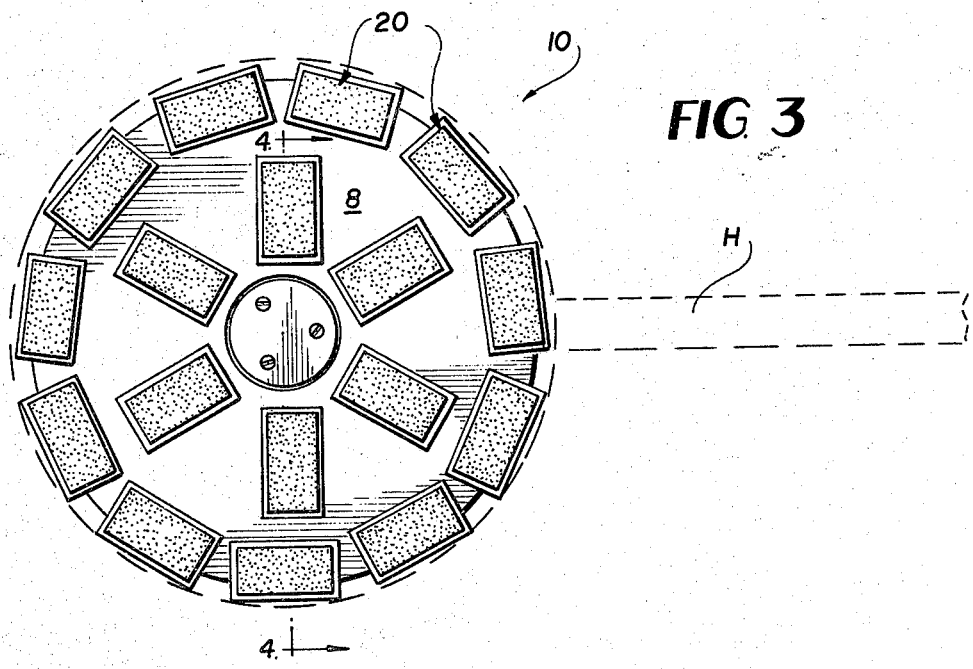
FIG. 3 is a bottom view of the view shown in FIG. 2.

Referring to the drawings now wherein like reference numerals refer to like parts throughout the various drawings, reference numeral 10 generally is directed to the floor machine according to the present invention.

This floor machine is seen to be provided with a handle H a motor M and a top plate 8 preferrably made of steel. Depending from and attached to the top plate 8 are a plurality of brushes 20 (FIG. 4).

The geometric center of the steel plate 8 is provided with a central drive area in which the motor M and it's downwardly depending shaft 1, provided with a key way 2, can extend into a means defining an opening 3 provided with slots 4 complemental to the key ways 2. This means defining an opening 3 is encased within a nylon or teflon support 5 which serves a further purpose to be delineated hereinafter.

The construction of the cleaning pad will now be defined. Each brush or polishing pad is provided with an upwardly extending bolt 11 adapted to go through the steel plate 8 of the floor machine and a top extremity of the bolt 11 is fastened thereto by means of a nut 9 and a lock washer 9'. Underneath the steel plate and surrounding the bolt 11 is a truncated conical shim 12 which is preferrably welded to a downwardly U-shaped configured support block having a planar horizontal face 13 and two opposed vertically facing support arms 14, each of these support arms 14 are provided with holes 15 as best seen in FIG. 7. Fastened to these arms 14 are angle irons 17 (vertical face) and 18 (horizontal face) at the opposed sides thereof and disposed inbetween the underneath within the crotch of the U-shaped block 13, 14 it is a toggle type spring 19. The means for fastening these four elements together is bolt 16 and nut 21. The horizontal face 18 of the angle irons is fixedly secured to the brush. Although the embodiment here depicts a brush having bristles 23 downwardly extending, it should be apparent that a buffing pad could be disposed thereon. In any event, the brush is provided with a block upper area 22 having rectangular configuration and a vertical perimetral wall 26 from which depends the bristles 23. The brush is fastened to the angle iron as by screws etc. Girding the outer periphery of the bristles 23 and supported by the top block portion of the brush at the perimetral wall 26 is a steel band 24 which extends around a portion of the bristled areas 23 and is fastened to the block by means of upwardly extending ear elements 25.

The purpose of the band 24 should therefor be readily apparent. The bristles due to the weight of the machine etc. will tend to splay out and these wire bristles in one form will be retarded from same by virtue of the constraint imposed by the steel band. Further, however this band can coact and cooperate with two other components now to be explained. In FIG. 7, the spring 19 is supported on the bolt-shaft in such a manner that the brush is capable of toggle or rocking action about that point at its axis. It should be seen therefor that undulations are a natural phenomena in most floors and therefor brush contact will be provided on even the most irregular floors. The spring in its natural configuration is biased so that it will tend to resist angulations in the floors but also conform to the depressions. The relationship between these brushes and the center support 5 can now be readily understood. The center support 5 made of teflon, plastic of the like, is supported on the plate 8 by L-shaped hardward elements 27 and by plural screws 6 which are counter sunk into the teflon support, said teflon support having a substantially T-shaped inverted configuration and is provided with a counter sunk area to accomodate the screw 6. These screws are supported on the steel plate at its top and bottom by bolts 7 and the extent of these screws is such that they can be vertically adjusted upwardly of downwardly. These screws also support the L-shaped hardware pieces 27 as shown in FIG. 4. Therefor, by displacing the support 5 in a positive or negative vertical direction, the distance in a vertical sense between the support 5 and brushes can be moderated. This, it can be seen, provides a control over the total angulation that each independent brush can effectively take, since in a severe depression, the motor handle steel plate would ultimately be supported by element 5.

Having thus described the invention, it should be apparent that numerous structural modifications are contemplated as being a part of this invention as set forth hereinabove and defined hereinbelow.

I claim:

1. A floating brush floor cleaner comprising a support plate, a motor, a handle connected to a housing surrounding said motor, a drive support mechanism to connect a shaft depending from said motor to said support plate, and a plurality of discrete floating brushes each depending from said support plate by means of an inverted U-shaped element each having an upwardly extending bolt which traverses through the support plate and is fastened thereto and said inverted U-shaped element has fastened on its downwardly extending legs a pair of angle irons on outer faces of said legs, a second bolt extending through said angle irons and said inverted U-shaped element pivotally supporting said angle irons relative to said U-shaped element, and a biasing spring disposed around said bolt second bolt and within a crotch portion of said U-shaped element, and one of said brushes depends from each pair of said angle irons whereby rocking can occur between said brush and said U-shaped element about said second bolt so that each of said brushes can conform to undulations in a floor surface.

2. The device of claim 1 in which the support within which said motor shaft extends is vertically adjustable.

3. The device of claim 2 in which said brushes are provided with a rectangular support block having bristles mounted thereon and said bristles extend downwardly therefrom and steel band surrounds the outer periphery of said bristles so that only a terminal portion of the bristles extend outwardly and downwardly, and said steel band is connected to a vertical perimetral wall of said block through upstanding ears.

4. The device of claim 3 which includes inner and outer brushes, wherein the inner most brushes have a longitudinal extent which eminates radially outwardly, and the outermost brushes are orthogonal thereto relative to said motor shaft.

5. The device of claim 4 in which a key is disposed on said motor shaft and a keyway is provided on said support plate for releasably fastening said support plate therefrom.

6. The device of claim 5 wherein said biasing spring includes a central coiled portion wrapped around said second bolt and outwardly extending terminal portions tangent to a top face of said rectangular support block.

* * * * *